US005088618A

United States Patent [19]

Colombo

[11] Patent Number: 5,088,618

[45] Date of Patent: Feb. 18, 1992

[54] CLEANING SYSTEM APPARATUS

[75] Inventor: Michael J. Colombo, Honolulu, Hi.

[73] Assignees: Jed Gaines; Michael J. Colombo, both of Honolulu, Hi.

[21] Appl. No.: 627,525

[22] Filed: Jul. 3, 1984

Related U.S. Application Data

[63] Continuation of Ser. No. 356,616, Mar. 9, 1982, abandoned.

[51] Int. Cl.[5] ..... B65D 6/08

[52] U.S. Cl. ..... 220/408; 220/486; 220/506

[58] Field of Search ..... 220/19.20, 22, 23.83, 220/23.86, 408, 409, 410, 486–488, 506, 9.1, 668; 15/264; 206/459; 40/306

[56] References Cited

U.S. PATENT DOCUMENTS

| | | | |
|---|---|---|---|
| 129,293 | 7/1872 | Page | 220/408 |
| 755,832 | 3/1904 | Anderson | 220/19 |
| 769,258 | 9/1904 | Falk | 40/306 |
| 1,018,492 | 2/1912 | Hilton | 220/22 |
| 1,229,912 | 6/1917 | Doncaster | 220/408 |
| 1,477,700 | 12/1923 | Fuller | 220/19 |
| 1,530,175 | 3/1925 | Hatch | 220/6 |
| 1,553,624 | 9/1925 | Merseles | 220/19 |
| 1,605,238 | 11/1926 | Jezik | 220/19 |
| 2,743,836 | 5/1956 | Roberts | 220/408 |
| 2,797,013 | 6/1957 | Powell | 220/19 |
| 3,342,368 | 9/1967 | Marty | 220/408 |
| 3,858,717 | 1/1975 | Peters | 206/459 |

*Primary Examiner*—Stephen Marcus
*Attorney, Agent, or Firm*—James C. Wray

[57] ABSTRACT

A cleaning system has a pail and a formed wire equipment holder constructed in a cylindrical shape to fit within the pail. The formed holder is constructed of coated metal wire. Any suitable material may be used. A centrally positioned bottle holder retains a bottle of a cleaning agent. The remainder of the space between the bottle holder and the holder boundary is sectioned into separate compartments to hold various cleaning implements—a sponge, a brush, a cloth, a scrubber, and a pumice stone. Wire feet support the base of the holder above the floor of the pail. The holder is also equipped with a folding wire handle to permit easy portability and removal from the cleaning pail.

20 Claims, 1 Drawing Sheet

FIG. 1
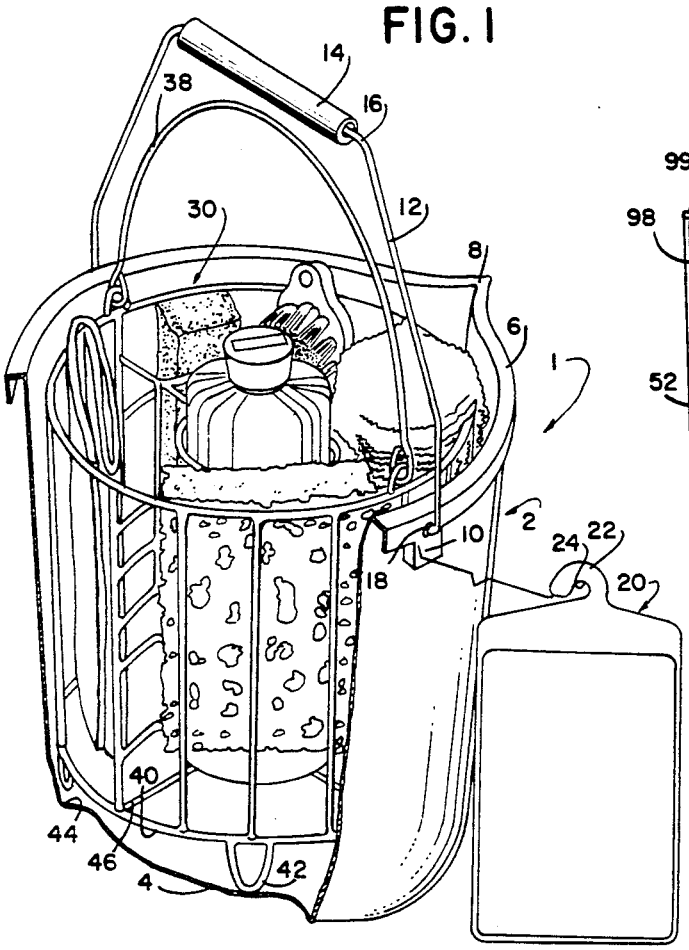
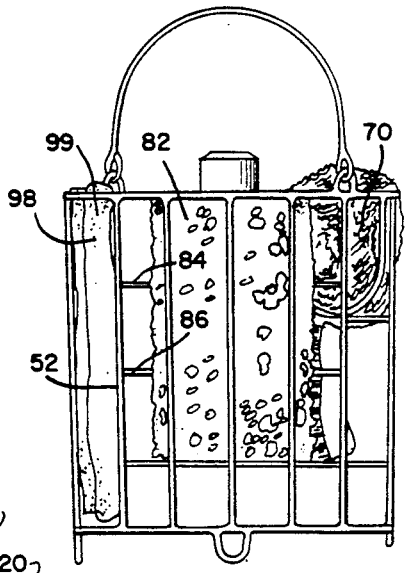
FIG. 2
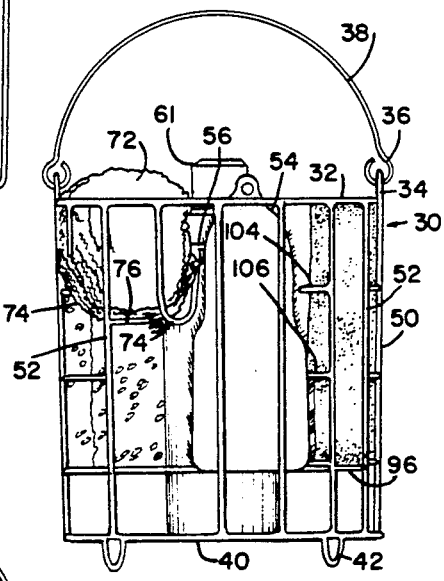
FIG. 3
FIG. 4
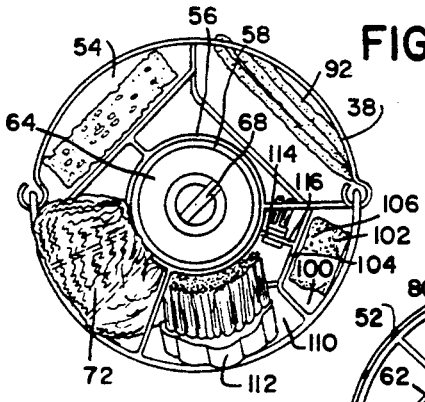
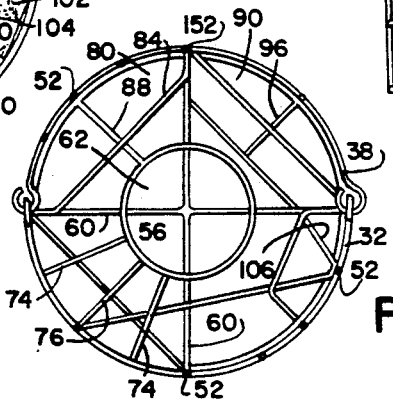
FIG. 5

CLEANING SYSTEM APPARATUS

This application is a continuation of application Ser. No. 356,616, filed Mar. 9, 1982, now abandoned.

BACKGROUND OF THE INVENTION

This invention relates to receptacles and more particularly to receptacles having separate compartments for holding cleaning supplies and implements above a floor of a pail.

Pertinent United States and foreign patents are found in Class 15, Brushing, Scrubbing and General Cleaning, subclasses 247 and 264; Class 113, Sheet-Metal Ware, Making, subclasses 44R, 44.12, 45.11, 214, 427, 499 and 515; Class 220, Metallic Receptacles, subclasses 19, 20, 23R, 23.83, 23.86, 401, 408 and 409; Class 222, Dispensing, subclasses 129 and 136; and Class 224, Package and Article Covers, subclasses 48R, 48W, 48D and 48E.

Examples of pertinent patents are U.S. Pat. Nos.:

| | | | |
|---|---|---|---|
| 149,407 | 909,715 | 1,218,574 | 3,378,134 |
| 1,633,022 | 1,752,361 | 2,507,152 | 3,065,877 |
| 2,740,546 | 2,762,674 | 2,832,500 | |
| 2,911,133 | 3,050,073 | 3,347,404 | |
| 3,103,226 | 3,378,134 | | |

U.S. Pat. No. 149,407 shows a painter's pail that is divided into sections to allow the user to carry both paints and brushes. The pail is fitted with a folding handle to permit easy portability of the pail.

U.S. Pat. No. 1,218,574 shows a pail that has a wire mesh basket that is formed to fit within the pail. The wire basket is also formed with handles to permit the basket to be removed from the pail.

U.S. Pat. No. 1,752,361 shows a pail that has a plurality of compartments formed within the pail. The compartments of the pail can be arranged in any position that is needed.

U.S. Pat. No. 2,740,546 shows a bucket that has removable components within the bucket itself. The components are held in position through the use of wire rods.

U.S. Pat. No. 2,832,500 shows a formed wire basket that has a folding handle and a formed wire center column. The basket is also fitted with a hoop to maintain the floor of the basket above the ground.

U.S. Pat. No. 3,103,226 shows a pail and a formed wire basket that are used together. The wire mesh basket is constructed to keep its floor above the floor of the bucket.

U.S. Pat. No. 3,347,404 shows a wire holder that holds containers when the containers are placed into cooking containers. The holder is constructed with a holder for easy removal from the larger container.

The listed patents not discussed above are less pertinent than those cited above. They further illustrate the state of the art in wire holders.

Holders of the type described above are not adequate for holding several cleaning supplies. Most are further unsuitable for holding a bottle containing cleaning solution and holding cleaning implements in individual separate compartments.

SUMMARY OF THE INVENTION

The present invention accomplishes what the prior art does not.

The present invention can hold a variety of cleaning implements and a centrally located bottle of cleaning solution. The implements and supplies are held above the floor of the pail to facilitate drainage of the implements into the pail. Handles on the holder and the pail allow the holder to be transported without dripping cleaning solution from the implements. Or the holder can be removed from the pail to provide a pail for mixing cleaning solution or for holding water. The holder, whether situated in the pail or removed therefrom, provides easy access to the cleaning implements and supplies. The entire apparatus can be conveniently stored under bathroom or kitchen cabinets or in a closet.

Objects of the invention are to provide an improved cleaning implement holder and to provide a holder for cleaning solution and for cleaning tools.

Another object of the invention is to provide a cleaning implement holder for centrally holding a bottle of cleaning solution and for holding a variety of cleaning implements around the bottle.

Another object of the invention is to provide convenient storage for cleaning implements.

Another object of the invention is to provide storage for wet implements at allow them to dry.

Another object of the invention is to provide for the draining of implements during use of other implements.

A cleaning system has a pail and a formed wire equipment holder constructed in a cylindrical shape to fit within the pail. The formed holder is constructed of coated metal wire. Any suitable material may be used. A centrally positioned bottle holder retains a bottle of a cleaning agent. The remainder of the space between the bottle holder and the holder boundary is sectioned into separate compartments to hold various cleaning implements—a sponge, a brush, a cloth, a scrubber, and a pumice stone. Wire feet support the base of the holder above the floor of the pail. The holder is also equipped with a folding wire handle to permit easy portability and removal from the cleaning pail.

An object of the invention is the provision of an apparatus for holding cleaning implements. A support is removably situated in a pail for supporting a plurality of cleaning supplies and equipment above the floor of the pail. Preferably, the support has a plurality of compartments for holding individual cleaning supplies and equipment. The support means is at least partially constructed of foramenous material to allow evaporation and drainage of fluids from supplies and equipment into the pail.

In a preferred embodiment, the support means is at least partially constructed of rigid wire. Preferably, the rigid wire is covered by rubber. In a preferred construction, the support means has a central cylindrical compartment. One apparatus for holding cleaning implements has a circular rigid wire botton and a plurality of straight rigid wire sections. Each is attached at both ends to the circular bottom for supporting equipment. A circular rigid wire top has diameter similar to or slightly larger than the diamater of the circular bottom. A plurality of rigid wire rods are attached at the opposite ends to the circular bottom. The wire rods are spaced around the top and bottom and are disposed generally perpendicular to planes containing the top and the bottom. A cylindrical rigid wire compartment is connected to at least one wire rod. The cylindrical compartment is concentric to a cylinder generally defined by the circular top, circular bottom and wire rods. A plurality of utensil compartments are connected to the wire rods, so that the compartments are situated between the cylindrical compartment and the wire rods. Preferably, a plurality of rigid wire loops are connected to the top. The loops project above the plane containing the top, and a rigid wire handle having eyes at both ends passes through the rigid wire loops. Preferably, the number of wire loops is two, and the rigid wire handle is in the shape of a semi-circle. In a preferred embodiment, rigid wire feet are connected to the bottom. The feet project downward generally perpendicular to the plane containing the bottom for supporting the bottom.

In one embodiment, four rigid feet are equally spaced around the circular bottom.

In a preferred embodiment of the invention, a pail having larger diameter than the diameter of the holding device receives the holding device.

These and other and further objects and features of the invention are apparent in the disclosure which includes the above and below specification, claims and drawings.

BRIEF DESCRIPTION OF THE DRAWINGS

FIG. 1 is a perspective, partially sectional view of a cleaning implement holder embodying the features of the present invention.

FIG. 2 is a side elevational view of the support device shown in FIG. 1.

FIG. 3 is a different side elevational view of the support device of FIG. 2.

FIG. 4 is a top plan view of the support device of FIG. 3.

FIG. 5 is a top plan view of the support device of FIG. 4 without implements or solution bottle.

DETAILED DESCRIPTION OF A PREFERRED EMBODIMENT

The cleaning system of the present invention is generally referred to by the number 1 in FIG. 1.

The cleaning system includes a plastic pail 2 with a slightly inverted base 4 and a rim 6 which is formed with a pouring lip 8. Rim 6 has a reinforced portion 10 to support a bail or handle 12. A roller-type handgrip 14 is mounted on a straight central portion 16 of pail 12. Part of the cleaning system is a laminated card 20 with written instructions for particular cleaning projects. The laminated card 20 has a hook 22 with an opening 24 which receives inward bend 18 of bail 12 where the bail joins the reinforced area of the rim of the pail.

In a preferred embodiment, the card 20 is a laminated card which may be a paper card on which printing appears, and the paper card is completely covered and sealed by liquid and gas impervious plastic. Alternatively, the card may be a plastic card with a single sheet or plural laminations in which the cleaning instructions are printed or impressed or engraved. The card may be made of any suitable material which is not subject to deterioration by fluids, especially cleaning fluids.

Pail 2 is constructed of any suitable material, for example, a rigid or resilient plastic material which is capable of maintaining its integrity and not splitting or cracking or otherwise deteriorating under ordinary conditions of its use and storage. The pail may be made of a metal or a coated metal, a plastic or a coated plastic or any suitable material which is preferred in constructing a lightweight, resilient, impact-resistant pail which is not subject to deterioration due to continued dampening with cleaning materials which may be used or stored in the pail.

A cleaning material holder is generally indicated by the numeral 30.

Holder 30 fits within the pail 2 in a manner so that foranemous walls of the holder are spaced from internal walls of the pail.

The holder may be made of any material which is capable of supporting cleaning equipment and which is suited for ventilating the cleaning equipment held therein. For example, the holder may be made of a plastic or metal or coated base material formed in spaced strips or formed in continuous sheets with holes punched or formed therein. The outer and base portions of the holders may be formed of like or distinct materials, and the inner partitions of the holder may be formed of like or different materials. The holder may be formed in any shape which is suited to fit within the pail 2. For example, the shape may be generally cylindrical or conical, cubical, hexagonal, octagonal or pyramidal.

In a preferred form of the invention, as shown in the drawings, the holder is constructed of wires which are welded or twisted together and which are subsequently coated with a rubber-like plastic material similar in construction to conventional dish drainers.

In the preferred embodiment, the holder is formed in several compartments. The compartments may be formed by an insert which is removable from the holder or by partitions which are integrally connected to the holder. In the preferred embodiment, the rubber-coated wires which form the partitions are integrally connected to the structure of the holder.

Referring to FIGS. 1-5, the holder 30 has a round upper rim 32 to which are attached opposite loops 34 for receiving hooks 36 on bail 38. As shown in FIG. 1, bail 38 is of such size as to be capable of being gripped with bail 12. At the same time, as shown in FIGS. 4 and 5, bail 38 is of such size as to fold along the upper rim 32 so that the bail may fit within the bucket 2 and, at the same time, may always lie upon the upper rim of the holder without falling between the wall of the holder and the wall of the bucket and without obscuring the compartments to retard removal of implements stored therein.

As shown in the drawings, the holder 30 has a generally planar base 40 which is supported on legs 42 above the base 4 of pail 2. Legs 42 may fit within a circumferential depression 44 in base 4 of pail 2. Base 40 is formed of a shape similar to upper rim 32 of the holder 30. The base 40 may be formed of a varied outer shape and may be slightly smaller than the upper rim so as to form an inverted, truncated, conical or pyramidal shape of the holder.

Preferably, the base is formed of diametrically extending rods 46. Additional diametrical rods or curvilinear or straight rods or bent rods at angles, such as shown in FIG. 5, may be used to form a base.

The sides 50 of the holder are formed with generally vertical rods 52 having lower ends connected to the base and upper ends connected to the upper rim 32. The generally vertical rods 52 may be slanted slightly outward to form a conical or pyramidal shape.

As shown in FIGS. 1-5, the compartment is divided into plural compartments 54. Each compartment is configured to hold a particular cleaning item.

In the preferred embodiment, the compartments are formed by two central rings 56 and 58 which are connected to outer elements 52 by radially extending rods 60 which are connected outwardly to the vertical rods 52 and which are connected inwardly to the rings 56 and 58. The two rings and the diametrical base members 46 form the central compartment 62 which is used for storage of a plastic bottle 64 which contains cleaning liquid. The bottle 64 containing the preferred biodegradable cleaning liquid is closed by a cap 66 which has a hinged pouring spout 68 which flips open and closed in a manner of a well known commercial shampoo bottle.

A compartment 70 for storage of a stainless steel scrubber 72 is formed with two or more downwardly looped elements 74 which are connected outwardly and upwardly to rim 32 and a central partially curved member 76 which is connected outwardly to a vertical member 52. Members 76 and 74 are connected inwardly and upwardly to upper ring 56. Compartment 80 for receiving sponge 82 is formed by upper and lower bent members 84 and 86 which are connected outwardly to vertical members 52. A radial member 88 extends inward from a vertical member 52 to lower ring 58 to form the bottom of compartment 80 and hold the sponge upwardly.

A compartment 90 for holding a folded scrub pad 92 or cloth, is formed by upper and lower members 94 and 96 which extend between spaced vertical members 52. Only upper member 94 is visible in FIGS. 4 and 5. Radial member 98 which extends from a vertical member 52 inward to lower ring 58 is shown in FIG. 5. Alternatively, as shown in FIG. 2, the radial member 98 may be replaced by a diametrical member which extends across bottom 40 so that a long cloth 99 may be stored in the elongated compartment 101.

A compartment 100 is provided for the storage of a pumice stone 102. Compartment 100 is made of upper and lower bent rods 104 and 106 which are attached at opposite ends to spaced vertical members 52. A base member 108 is formed of a long bent rod which is connected to vertical members 52, as shown in FIG. 5, to support the pumice stone. Rod 108 also forms the base support for compartment 110 which holds the large scrub brush 112 as shown in FIG. 5 Rod 108 is bent to appear V-shaped and has a relatively long segment and a relatively short segment. Sides of the compartment 110 are formed by members which are used to form sides of other compartments.

A small scrub brush 114 may be hung on hook 116 which is connected to upper member 104 of compartment 100.

In use, a person first reads the cleaning card to see what portion of liquid from bottle 64 to use in a particular amount of water at the pail 2. Alternatively, one finds out how to wet the cleaning instrument with cleaning fluid or a solution of cleaning fluid and water. One raises bail 38 and lifts the holder 30 out of pail 2. Bottle 64 is removed from the central compartment, the spout 68 is raised on the bottle and an amount of cleaning liquid is poured into the bottom of the pail. The proper amount of water is added to pail 2. Bottle 64 is returned to its compartment, and the appropriate cleaning device is removed from its compartment and used in the cleaning operation.

After water is dumped from the container, the cleaning instrument is squeezed or shaken to remove excess liquid and then it is replaced in its compartment. The holder 30 is then returned to the empty pail 2 which is stored, such as beneath a sink.

While the invention has been described with reference to specific embodiments, further embodiments of the invention are apparent from the disclosure and are encompassed within the claims, which particularly describe the scope of the invention.

I claim:

1. An apparatus comprising an open container for holding cleaning implements, the container having a rigid base constructed of interconnected wires, a plurality of wire legs extending downward from the base for supporting the base above the bottom of a bucket, rigid outer rods extending upward from the base to an upper rim, a central section positioned above the base and having wire rings positioned upward therefrom for holding cleaning material, and wire dividers extending outward from the central section to the outer rods and being connected thereto and compartments between the wire dividers for receiving cleaning implements, and a handle connected to the upper rim adjacent an upper extremity thereof so that the container may be lifted from a bucked on which it is supported by the legs extending downward from the bottom, whereby the cleaning material and implements may be stored in a bucket spaced from the walls of the bucket by the open container so that the implements may have ventilation and so that the cleaning material and implements may be lifted from the bucket by lifting the handle of the container prior to use of the bucket for cleaning operations with water and the cleaning material and the implements.

2. The apparatus of claim 1 further comprising plural wire formed dividers extending across adjacent sections of the outer rods of the container and connected thereto for forming with the outer rods generally flat compartments for holding scrub pads and sponges.

3. The apparatus of claim 1 further comprising generally horizontally positioned wire formed dividers extending from a portion of the outer rods to the central section for forming in cooperation with adjacent dividers relatively shallow upward opening compartments for receiving relatively small cleaning implements such as tangled wire-type scrubbers.

4. The apparatus of claim 1 wherein the base comprises a peripheral wire bent in the shape of a pail in which the container is to be positioned and crossed wires having ends connected to the peripheral wire and extending between spaced portions of the peripheral wire and wherein the legs comprise looped wires having upper ends connected to the peripheral wire of the base and wherein the outer rods comprises generally vertically oriented wires having lower ends connected to the peripheral wire of the base and having upper ends remote from the base and the rim is an upper peripheral wire connected to upper ends of the generally vertical wires and wherein the handle comprises a wire having a shape similar to the upper peripheral wire and having eye-shaped opposite ends and U-shaped loops passing through the eye-shaped ends and having ends of the loops connected to the upper peripheral wire.

5. The apparatus of claim 4 wherein the dividers further comprise plural wires having outer ends connected to the vertical wires and extending inward therefrom.

6. The apparatus of claim 5 wherein the central compartment comprises a circular bent wire spaced inward from the upper outer peripheral wire by divider wires.

7. The apparatus of claim 6 further comprising cleaning material liquid disposed in a plastic bottle disposed in the central section, the bottle having an upper portion extending upward from the central section, a pumice stone in one compartment having an upper portion extending upward from the compartment, a scrub brush in another compartment having an upper portion extending upward from the compartment, a folded scrub pad in a relatively narrow compartment, a sponge in a second relatively narrow compartment and a tangle wire-type scrubber disposed in a relatively shallow compartment and extending upward therefrom, a bucket surrounding the container, the bucket having a base with a depressed peripheral portion receiving the legs of the container and thereby centering the legs within the depression and centering the container above the base and the bucket having a side wall spaced outwardly from the outer wall of the container to promote circulation around the cleaning implements within the container and the bucket having a handle connected to an upper edge of the wall and extending above a container handle whereby the bucket handle may be passed by the container handle and whereby the bucket and container handle may be grasped by lifting the container handle and the container with respect to the bucket and further comprising an instruction card having a facial area for containing cleaning instructions and having an upper hook connected to the bucket handle for supporting the card on the bucket handle to provide instructions for use of the bucket, the cleaning material and the cleaning implements.

8. An apparatus for storing, organizing and carrying a variety of cleaning implements comprising:

a pail and a holder removably placed within the pail, the holder comprising a (first) circular lower rim, a first circular upper rim, vertical rods extending rigidly between the (first) circular lower rim and the first circular upper rim to form side-walls, horizontal diametrical base members forming a base and being connected to the (first) circular lower rim, the first circular upper rim, the lower rim, the horizontal diametrical base members and the vertical rods forming a cylindrical compartment with cylindrical side walls and a horizontal base, (a second circular lower rim concentric with and vertically spaced above the first circular lower rim and being smaller in diameter than the first circular rim), second circular upper rim concentric with the first circular upper rim (and second circular lower rim), the second circular upper rim being vertically spaced below the first circular upper rim, a plurality of radially extending horizontal rods being connected outwardly to the vertical rods and inwardly to the second circular upper (and lower) rim(s), horizontal dimetrical base members and the second circular upper (and lower) rim(s) forming a first sub-compartment having a cylindrical shape and being coaxial with the cylindrical compartment.

9. The apparatus of claim 8 further comprising:

a plurality of downwardly looped elements being connected outwardly and upwardly to the first circular upper rim, inwardly and upwardly to the second circular upper rim, and a partially curved element being connected outwardly to one of the vertical rods and being connected upwardly and inwardly to the second circular upper rim, the downwardly looped elements and the partially curved element forming a second sub-compartment in an upper portion of the holder.

10. The apparatus of claim 9 further comprising:

first upper and lower horizontal bent rods being vertically co-planar and extending radially inwardly for a segment, and extending transverse a portion of the cylindrical compartment, each being connected outwardly to one of the vertical rods, (and a first radial member extending inwardly from one of the vertical rods to the second circular lower rim,) the first upper and lower horizontal bent rods and the cylindrical side wall of the cylindrical compartment defining a third sub-compartment having an arcuate shape, and being spaced from the first sub-compartment.

11. The apparatus of claim 10 further comprising:

upper and lower rods, being vertically co-planar and extending transverse a portion of the cylindrical compartment between two of the vertical rods, a radial member extending inwardly from one of the vertical rods toward the center of the holder, the upper and lower horizontal rods and the second radial member forming a fourth sub-compartment having an arcuate shape, and being spaced from the first sub-compartment.

12. The apparatus of claim 8 further comprising:

second upper and lower horizontal bent rods connected at opposite ends to spaced vertical rods, a bent horizontal base member connected to spaced vertical rods, the second upper and lower bent rods and the bent horizontal base member forming a fifth sub-compartment spaced from the first sub-compartment.

13. The apparatus of claim 8 further comprising:

second, third, fourth, fifth and sixth sub-compartments, all of the sub-compartments having horizontally co-planar bases vertically spaced above the base of the cylindrical compartment.

14. The apparatus of claim 11 wherein the radial member consists of a horizontal diametrical base member.

15. The apparatus of claim 11 wherein the radial member extends inwardly from one of the vertical rods to the center of the lower rim.

16. The apparatus of claim 9 further comprising:

first upper and lower horizontal bent rods being vertically co-planar and extending radially inwardly for a segment and extending transverse a portion of the cylindrical compartment, each being connected outwardly to spaced vertical rods, a first radial member extending inwardly from one of the vertical rods to the second circular lower rim, the first upper and lower bent rods and the first radial member forming a third sub-compartment having an arcuate shape and being adjacent the second sub-compartment, upper and lower horizontal rods being vertically co-planar and extending transverse a portion of the cylindrical compartment between two spaced vertical rods, a second radial member extending inwardly from one of the spaced vertical rods toward the center of the holder, the upper and lower horizontal rods and the second radial member forming a fourth sub-compartment having an arcuate shape and being adjacent the third sub-compartment, second upper and lower horizontal bent rods connected at opposite ends to spaced vertical rods, a bent horizontal base member connected to spaced vertical rods, the second upper and lower horizontal bent rods and the bent horizontal base member forming a fifth sub-compartment and being adjacent to the fourth sub-compartment, sides of the first, second and fifth sub-compartments defining a sixth sub-compartment having an irregular shape.

17. The apparatus of claim 16 wherein the second and sixth sub-compartments adjoin the first sub-compartment and the third, fourth and fifth sub-compartments are spaced from the first sub-compartment.

18. An apparatus of claim 8 further comprising:

a plurality of rigid wire feet fixedly connected to the bottom, the feet projecting downward and perpendicular to the plane containing the bottom for supporting the bottom.

19. An apparatus of claim 8 wherein the pail has dimensions larger than dimensions of the holder for receiving the holder, and the pail has a pail handle with ends having rotatable connection to eh pail to allow rotation of the pail handle out of the path of the holding device when the holding device is inserted into the pail or when the holding device is removed from the pail.

20. The apparatus of claim 8 wherein the holder has a plurality of rigid wire loops fixedly connected to the top, the loops projecting above the plane containing the top, and a rigid wire handle having eves at both ends passing through the rigid wire loop, the rigid wire handle being semi-circular in shape.

* * * * *